US011624281B1

(12) United States Patent
Zahavi

(10) Patent No.: US 11,624,281 B1
(45) Date of Patent: Apr. 11, 2023

(54) INTERNAL RESTRAINING PATH IN A ROTOR

(71) Applicant: Avi Dov Zahavi, Tel Aviv (IL)

(72) Inventor: Avi Dov Zahavi, Tel Aviv (IL)

( * ) Notice: Subject to any disclaimer, the term of this patent is extended or adjusted under 35 U.S.C. 154(b) by 0 days.

(21) Appl. No.: 17/586,888

(22) Filed: Jan. 28, 2022

(30) Foreign Application Priority Data

Jan. 18, 2022 (IL) ..... 289960

(51) Int. Cl.

| | |
|---|---|
| ***F01B 9/06*** | (2006.01) |
| ***F02B 75/28*** | (2006.01) |
| ***F01B 7/04*** | (2006.01) |
| *F02B 75/02* | (2006.01) |

(52) U.S. Cl.
CPC ..... *F01B 9/06* (2013.01); *F01B 7/04* (2013.01); *F02B 75/28* (2013.01); *F02B 2075/025* (2013.01)

(58) Field of Classification Search
CPC ..... F01B 9/06; F01B 7/04; F01B 2009/061; F01B 2009/065; F02B 75/28; F02B 2075/025
See application file for complete search history.

(56) References Cited

U.S. PATENT DOCUMENTS

| | | | | |
|---|---|---|---|---|
| 8,186,316 B2 * | 5/2012 | Evgeni | F01B 9/06 | 123/70 R |
| 2009/0194071 A1 * | 8/2009 | Sorrels | F01B 9/06 | 123/45 R |

* cited by examiner

*Primary Examiner* — Jacob M Amick
(74) *Attorney, Agent, or Firm* — William H. Dippert; Laurence A. Greenberg; Werner H. Stemer

(57) ABSTRACT

An improvement to a rotor is provided adapted to be rotated by at least two linearly moving support bearings linearly driven by an engine that comprises an outer ring provided on a circumference of the rotor; and an inner ring that is concentric to the outer ring. The support bearings are confined to rotate within a restraining path formed between the outer ring and the inner ring. It is also provided an improved engine having at least two traverses linearly actuated that comprises the improvement.

14 Claims, 3 Drawing Sheets

Figure 1 – PRIOR ART

INTERNAL RESTRAINING PATH IN A ROTOR

CROSS-REFERENCE TO RELATED PATENT APPLICATION

This patent application is based upon and claims the priority of Israeli Patent Application No. 289960, filed Jan. 18, 2022, incorporated herein by reference.

TECHNICAL FIELD OF THE INVENTION

The present disclosed subject matter relates to engines. More particularly, the present subject matter relates to internal restraining element in a piston engine.

BACKGROUND OF THE INVENTION

Piston engines, for example the engine disclosed in U.S. Pat. No. 8,186,316, hereby entirely incorporated by reference, describes a two-stroke opposite radial rotary-piston engine. The piston engine comprising a block including sleeves, pairs of pistons disposed within the sleeves and oppositely movable, a power takeoff shaft, two parallel positioned rotors mounted thereon having an inner surface formed by a closed curved line. The rotors have concaved surface portions. Cross-like traverses are mounted, pair-wise spanning the pistons. The traverses are associated with engagement means, cooperating with the concaved portions. The engine comprises support bearings coupled to the traverses. Support bearings include an external bushing, rolling over the rotor's inner surface, thereby impelling the rotor. The engagement means are mounted in the region of contact of the support bearings and rotors, thereby eliminating lateral force moment, extending the lifespan of the engine. Other elements, module engine embodiments with different angular positions of the rotors, and power installation embodiments are disclosed, enhancing the efficiency, size, weight, and power variety of the engine. The engine comprises two substantially identical rotors mounted on a shaft, situated outwardly in relation to housings, and fixed to the shaft. The rotors are disposed substantially symmetrically in relation to the central cross-section plane positioned perpendicularly to the longitudinal axis of the shaft. The inner surface of the rotors, facing the housing, has a cylindrical geometrical shape with its periphery formed by a generatrix moved along a predetermined Cassini line.

The two substantially identical rotors fixedly mounted on the takeoff shaft outwardly in relation to the stationary housing, wherein each of the rotors has an inner operation surface, facing the stationary housing, and formed by a predetermined curved line of a closed type having a transverse axe and a longitudinal axe, wherein the corresponding axes of the two rotors of said module are aligned in parallel, and wherein the each of said rotors each on the frontal part of its outer surface includes a peripheral concaved surface portion made therein along said curved line.

The forces, load, friction and heating inside the engine, and especially in the area of the rotor and the housings, are very strong and the parts need to be firmly controlled in order to avoid explosions or other damage to the engine when it is operating. Many attempts to control the forces are known, but their efficiency is low, including adding the predetermined curved line of a closed type having a transverse axe and a longitudinal axe. Other partly solutions are provided herein as examples:

U.S. Pat. No. 2,227,853 discloses a multiple-piston engine that discloses an engine having fly wheels with inner face of each of the fly wheels that is a cam track, these cam tracks being elliptical in shape and consisting of an outer flange and an inner elliptical plate secured to the inner face of each of the fly wheels as by means of studs. The periphery of each of the flanges is parallel to the periphery of each of the plates, but the peripheries of the plates are slightly off-set with respect to the outer edge of each of the flanges, the arrangement being that the cam followers will ride the periphery of the plate, while the slightly larger cam followers will ride the inner surface of the flanges.

WO2015038033 discloses a piston engine comprising a first base with a shaft mounted perpendicularly thereto and two guides in the form of ellipses disposed on different sides of the base in such a way that their major axes are mutually perpendicular, and a second base with four cylinders mounted in pairs with central symmetry about the axis of the shaft. Each cylinder has two pistons mounted therein, which are connected by a rod, at the middle of which rod are two projections with two rollers on each projection, each pair of rollers interacting with one of the guides.

DE743617 discloses an opposed piston engine with two adjacent parallel cylinders, which means that the piston moves by rolling or the like on cam disks is transmitted, characterized in that the cylinder on both sides of a standing perpendicular to the plane of the cylinder axis, bearing the cam disks, between the cylinders through shaft are arranged.

RU2167321 discloses an axial internal combustion engine comprising axial internal combustion engine that has housing, four pairs of opposite cylinders, eight pistons rigidly connected by rods to shafts of rollers and arranged in cylinders to form working chambers, and mechanism converting reciprocating motion into rotary motion. This mechanism is connected to power takeoff shafts and is made of two flywheels provided with oval-shaped grooves on end faces for sliding of working rollers. Two support faceplates rigidly secured on engine housing are provided with four slots to permit sliding of support rollers. Engine has two pairs of shafts on ends of which support and working rollers are press-fitted to convert reciprocating motion into rotary motion providing eight working strokes at each revolution of shaft. This engine has increased efficiency, simplified manufacturing, increased service life at reduced fuel consumption.

RU200107 discloses a connecting rod rotor motor intended for use in engine building and other industries. The engine can be used as a source of mechanical energy for machines and mechanisms of land, water and air transport, for driving various industrial and household units. The technical result is to improve the reliability of the engine. The essence of the utility model lies in the fact that the rotorless rotor engine contains a housing in which cylinders with combustion chambers and pistons are located and a mechanism for converting reciprocating motion into rotary motion. The pistons are rigidly connected by rods with the shafts of the rollers. On the housing for each of the cylinders, an ignition contact is fixed and a rotor is installed, inside which an elliptical cavity is made with two ignition projections and three T-shaped elliptical grooves. Cylinders with their middle part are fixed at an angle of 120° to each other on the housing sequentially along the axis of the rotor and perpendicular to the axis of the rotor. Each cylinder contains two pistons and, one combustion chamber and a spark plug. Each piston has two parallel rods, the free ends of which are brought out of the housing through two linear bearings. At the opposite ends of the rods, a shaft with two rollers is fixed.

BRIEF SUMMARY OF THE INVENTION

It is an object of the present subject matter to provide an engine having at least two traverses linearly actuated, the engine comprising:

at least one rotor having an inner surface of an outer ring, wherein the rotor is mounted on a shaft of the engine, wherein the at least one rotor is fixed to the shaft that passes through the engine;

at least two support bearings provided to the at least one rotor, wherein the support bearings are mounted oppositely within the rotor, each support bearing has a revolving insertion positioned between an external ring and an internal ring, wherein the at least two support bearings are connected to the traverses, and wherein the external ring rolls over the inner surface of the rotor so that a linear movement of the traverses is converted to rotation of the rotor; and an inner ring that is concentric to the outer ring wherein an outer surface of the inner ring is distant from the inner surface of the outer ring in a distance that corresponds the diameter of the external ring of the supporting bearing, wherein the outer ring and the inner ring form an internal restraining path in which the at least two supporting bearings rotate.

In accordance with another preferred embodiment of the present subject matter, the engine is further provided with pistons that actuate the traverses and the rotors are positioned outwardly of both sides of a housing that accommodate the pistons.

In accordance with another preferred embodiment of the present subject matter, the outer ring is oval.

In accordance with another preferred embodiment of the present subject matter, the support bearings are of a slipper type.

In accordance with another preferred embodiment of the present subject matter, the engine further comprising two pairs of guiding bearings that absorb lateral forces produced during interactions of the support bearings with the rotors.

In accordance with another preferred embodiment of the present subject matter, each of the guiding bearings comprises a movable part consisting of two slides and a fixed part, and wherein the slides are fixed to the traverse while the fixed part is secured to the housing.

In accordance with another preferred embodiment of the present subject matter, the engine further comprises two engagement units, each is engaging the inner surface of the rotor and the corresponding traverse.

In accordance with another preferred embodiment of the present subject matter, the engagement unit is a movable unit that includes an engagement slide capable of sliding along an engagement guide and a rolling bearing that is mounted on the slide.

In accordance with another preferred embodiment of the present subject matter, the inner ring act as an internal restraining element that prevents the support bearing from detaching of the inner surface of the outer ring.

It is provided in accordance with yet another p[referred embodiment of the present subject matter an improvement to a rotor adapted to be rotated by at least two linearly moving support bearings linearly driven by an engine, the improvement comprising:

an outer ring provided on a circumference of the rotor; and an inner ring that is concentric to the outer ring, wherein the support bearings are confined to rotate within a restraining path formed between the outer ring and the inner ring.

The improvement as claimed in claim 10, wherein the rotor is ovel shaped.

In accordance with another preferred embodiment of the present subject matter, the inner ring acts as an internal restraining element that is strong enough to endure the environmental conditions and forces inside the engine.

In accordance with another preferred embodiment of the present subject matter, the support bearings are connected to traverses that are linearly actuated by pistons of the engine.

Unless otherwise defined, all technical and scientific terms used herein have the same meaning as commonly understood by one of ordinary skill in the art to which this disclosed subject matter belongs. Although methods and materials similar or equivalent to those described herein can be used in the practice or testing of the present disclosed subject matter, suitable methods and materials are described below. In case of conflict, the specification, including definitions, will control. In addition, the materials, methods, and examples are illustrative only and not intended to be limiting.

BRIEF DESCRIPTION OF THE DRAWINGS

Some embodiments of the disclosed subject matter described, by way of example only, with reference to the accompanying drawings. With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the disclosed subject matter. In this regard, no attempt is made to show structural details of the disclosed subject matter in more detail than is necessary for a fundamental understanding of the disclosed subject matter, the description taken with the drawings making apparent to those skilled in the art how the several forms of the disclosed subject matter may be embodied in practice.

In the Drawings.

DETAILED DESCRIPTION OF THE INVENTION

Figure 1:
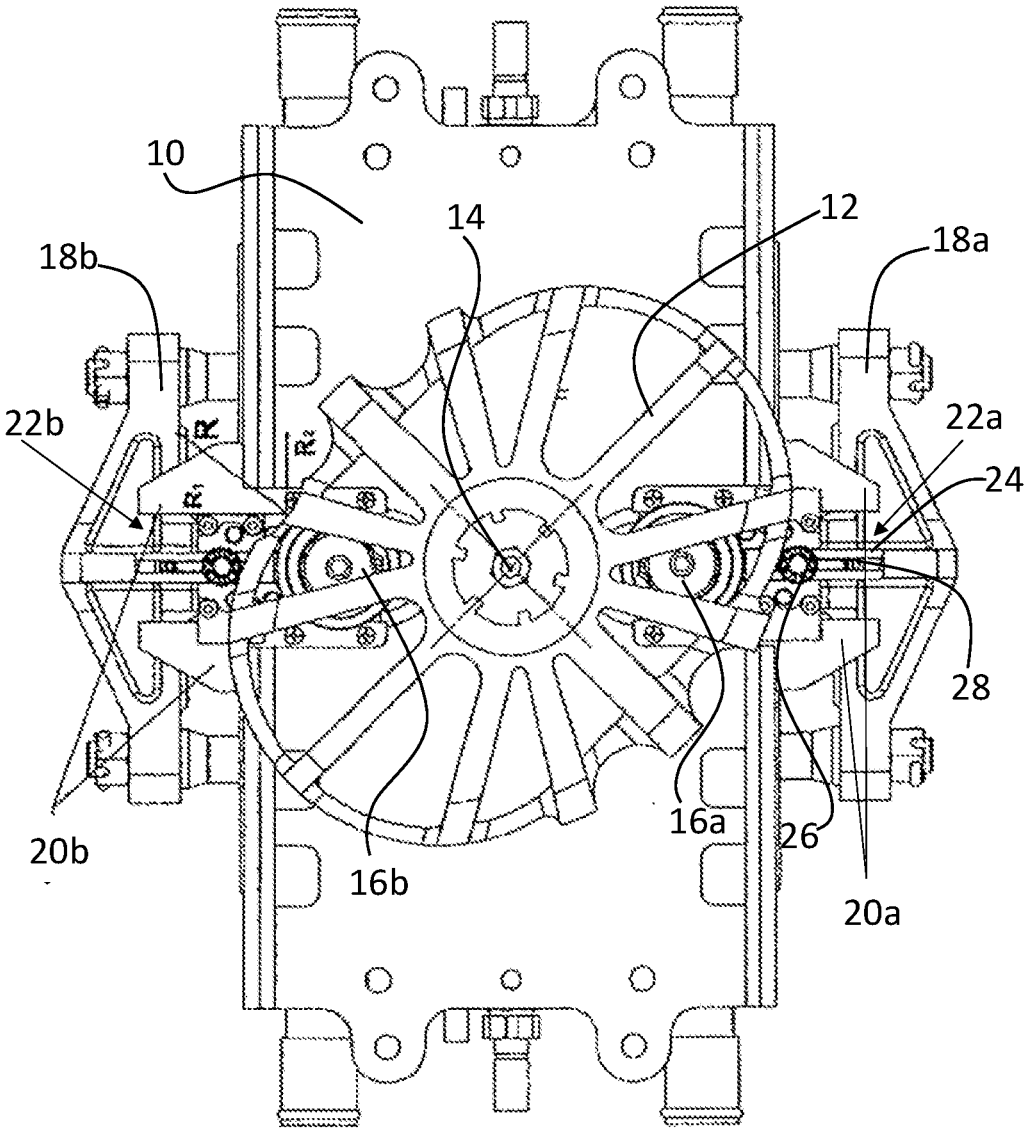
FIG. 1 schematically illustrates a part of a piston engine—PRIOR ART.

Before explaining at least one embodiment of the disclosed subject matter in detail, it is to be understood that the disclosed subject matter is not limited in its application to the details of construction and the arrangement of the components set forth in the following description or illustrated in the drawings. The disclosed subject matter is capable of other embodiments or of being practiced or carried out in various ways. Also, it is to be understood that the phraseology and terminology employed herein is for the purpose of description and should not be regarded as limiting. The drawings are generally not to scale. For clarity, non-essential elements were omitted from some of the drawings.

The terms "comprises", "comprising", "includes", "including", and "having" together with their conjugates mean "including but not limited to". The term "consisting of" has the same meaning as "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this disclosed subject matter may be presented in a range format. It should be understood that the description in range format is merely for convenience and brevity and should not be construed as an inflexible limitation on the scope of the disclosed subject matter. Accordingly, the description of a range should be considered to have specifically disclosed all the possible sub-ranges as well as individual numerical values within that range.

It is appreciated that certain features of the disclosed subject matter, which are, for clarity, described in the context of separate embodiments, may also be provided in combination in a single embodiment. Conversely, various features of the disclosed subject matter, which are, for brevity, described in the context of a single embodiment, may also be provided separately or in any suitable sub-combination or as suitable in any other described embodiment of the disclosed subject matter. Certain features described in the context of various embodiments are not to be considered essential features of those embodiments, unless the embodiment is inoperative without those elements.

It is an object of the present subject matter to provide an improvement to rotors of a radial rotary piston engine, especially rotors that are depicted at least in U.S. Pat. Nos. 7,832,368 and 8,186,316. The rotary piston engines are prone to vibrations especially in high speeds. This feature reduces the efficiency of the engine and can cause damage to the parts, in cases the vibrations are extensive.

According to a preferred embodiment of the present subject matter, an engine is provided having at least two traverses linearly actuated, the engine comprises at least one rotor having an inner surface of an outer ring, wherein the rotor is mounted on a shaft of the engine, wherein the at least one rotor is fixed to the shaft that passes through the engine; at least two support bearings provided to the at least one rotor, wherein the support bearings are mounted oppositely within the rotor, each support bearing has a revolving insertion positioned between an external ring and an internal ring, wherein the at least two support bearings are connected to the traverses, and wherein the external ring rolls over the inner surface of the rotor so that a linear movement of the traverses is converted to rotation of the rotor; and an inner ring that is concentric to the outer ring wherein an outer surface of the inner ring is distant from the inner surface of the outer ring in a distance that corresponds the diameter of the external ring of the supporting bearing, wherein the outer ring and the inner ring form an internal restraining path in which the at least two supporting bearings rotate.

According to another preferred embodiment of the present subject matter, an improvement to a rotor adapted to be rotated by at least two linearly moving support bearings linearly driven by an engine is provided, the improvement comprises an outer ring provided on a circumference of the rotor; and an inner ring that is concentric to the outer ring, wherein the support bearings are confined to rotate within a restraining path formed between the outer ring and the inner ring.

Reference is now made to FIG. 1 schematically illustrating a part of a piston engine according to prior art radial rotary piston engine. The part of the radial rotary piston engine that is depicted in FIG. 1 is the rotor shown at least in FIG. 6*b* in U.S. Pat. No. 8,186,316. The engine (cannot be seen in the figure since it is hidden within a housing 10 comprises two substantially identical rotors, one of which is seen as rotor 12, mounted on both sides of a shaft 14 that pass through the engine and the housing 10. Rotors 12 are situated outwardly in relation to the housings 10 and are fixed to the shaft 14 (only one rotor can be seen in the figures).

Two conventional support bearings 16*a* and 16*b*, preferably of a slipper type, are mounted oppositely within the rotor, each of the support bearing comprises an external cylindrical ring, an internal cylindrical ring, and an insertion therebetween capable of revolving. The support bearings are connected to cross shaped traverses 18*a* and 18*b*, respectively, that is actuated by the pistons (not shown herewith) to move in a linear movement. The external ring rolls over the inner surface of the rotor 12 impelling it, and thereby converting the linear movement of the traverses 18*a* and 18*b*, respectively, into rotation of the rotor 12.

The engine further comprises two pairs of guiding bearings 20*a* and 20*b* that absorb lateral forces produced during interactions of the support bearings 16*a* and 16*b* with the rotors 12. Each of the guiding bearing 20*a* and 20*b* comprises a movable part consisting of two slides and a fixed part. The slides are fixed to the traverse 18 (either a or b) while the fixed part is secured to the housing 10.

The engine is further provided with two engagement units 22*a* and 22*b*, each is engaging the inner surface of the rotor 12 (either a orb) and the traverse 18 (either a or b). The engagement unit is a movable unit that includes an engagement slide capable of sliding along an engagement guide 24 and a rolling bearing 26 that is mounted on the slide. Note that there is a guide, a slide, a rolling bearing, and a spring on each side of the engine, although only one unit (22*a*) is described in details. An engagement spring 28, situated inside the guide 24 cause the engagement unit 22 (either a or b) to permanently be depressed against the rotor 12 (either a or b, respectively), and, at the same time, has a freedom to move, providing a strike-less engagement of the rotors during a start.

It should be noted that only details that are relevant to the improvement of the present subject matter is depicted herein.

One of the shortcomings of the operation of the rotors 12*a* and 12*b* and the supporting bearings 16*a* and 16*b* of the prior art is that they are efficiently operated in low rounds per minute, however, in high speeds, the supporting bearings are prone to failure.

Figure 2:
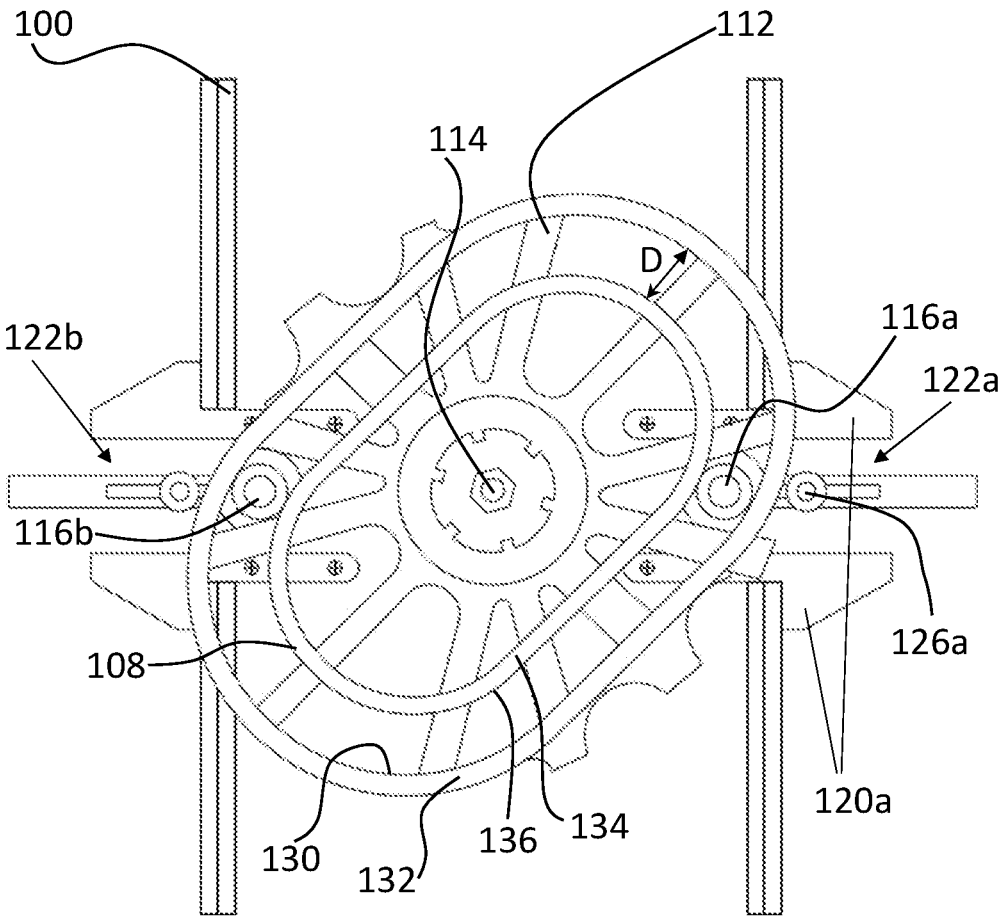
FIG. 2 schematically illustrates part of a piston engine with internal restraining element in accordance with some exemplary embodiments of the disclosed subject matter.
Figure 3:
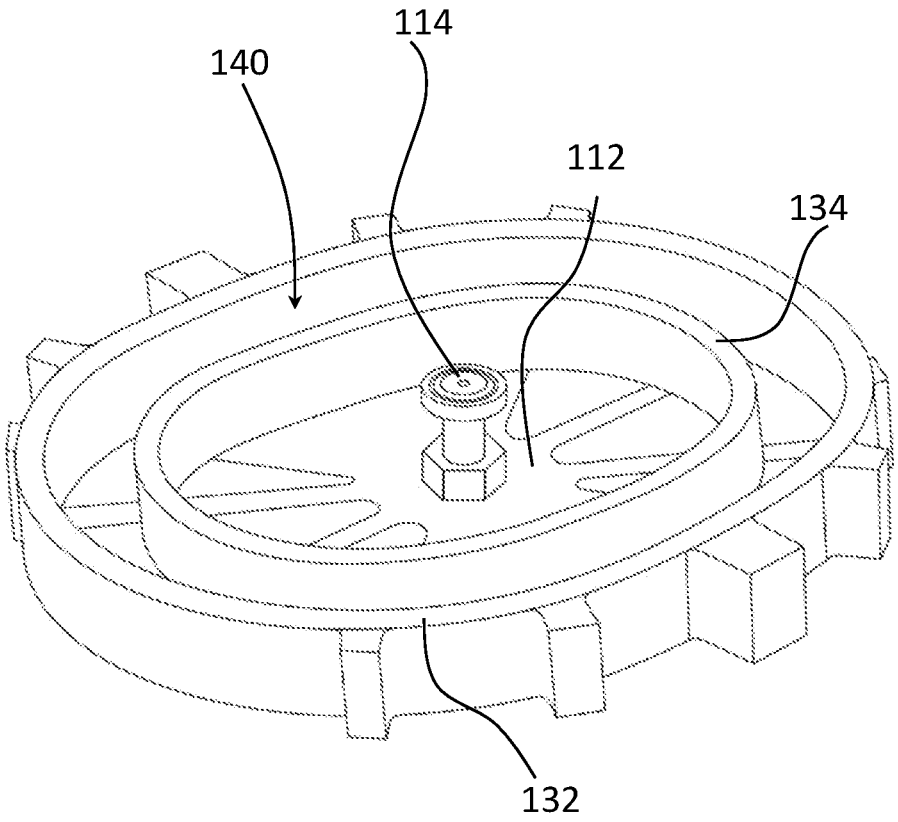
FIG. 3 schematically illustrates an internal restraining path in a rotor in accordance with some exemplary embodiments of the disclosed subject matter.

Referring now to FIG. 2, schematically illustrating part of a piston engine with internal restraining element in accordance with some exemplary embodiments of the disclosed subject matter. A piston engine (the whole engine is not seen herein), which is a centrifugal-piston or rotary-piston engine, is provided with at least one rotor, however, preferably two rotors 112*a* and 112, oppositely positioned on both sides of a shaft 114 that passes through the engine.

Two conventional support bearings 116*a* and 116*b*, preferably of a slipper type, are mounted oppositely within the rotor 112, each of the support bearings comprises an external cylindrical ring, an internal cylindrical ring, and an insertion therebetween capable of revolving. The external ring rolls over an inner surface 130 of the oval outer ring 132 of the rotor 112, impelling it, and thereby converting the linear movement of the pistons (through a pair of guiding bearings 120*a* and 120*b* (only 120*a* is indicated)) into rotation of the rotor 12.

As mentioned herein before, the rotation of the rotor 112 in the high speeds can be jeopardized due to the supporting bearings 116*a* and 116*b* that are engaged with the traverses through engagement units 122*a* and 122*b*.

In accordance with some exemplary embodiments of the present subject matter, in order to prevent disengagement of the supporting bearings 116*a* and 116*b* from the rotor 112, another inner ring 134 that is concentric to the oval outer ring 132 is provided. The outer surface 136 of the inner ring 134 is distant from the inner surface 130 of the outer ring 132 in a distance that corresponds the diameter of the external ring of the supporting bearing 116 (either a or b).

The two rings, the outer ring 132 and the inner ring 134 form an internal restraining path of a distance D that correspond to the diameter of the supporting bearings 116*a* and 116*b* that are configured to move within the path. Adding the inner ring 134 and forming the internal restraining path provides a strike-less engagement of the rotor and allows all moving parts to be controlled and move alongside and within the path borders.

In accordance with another preferred embodiment of the present subject matter, the rotor can be design with different number of ribs or with holes within a plate like surface of the rotor.

Referring now to FIG. 2, illustrating an internal restraining path in a rotor in accordance with some exemplary embodiments of the disclosed subject matter. Internal restraining path 140 is configures to deprive some of the freedom of movement of the moving parts of the engine—and particularly the supporting bearings (not shown in this figure), and to eliminate the radial forces exerted by the moving parts upon the cylinder walls. The inner ring 134 that acts as an internal restraining element is preferably made from the same material as the outer ring 132, or can be made from any material that is strong enough to handle all forces applied on the element and that can endure the environmental conditions and forces inside the engine, especially during high rotation speed.

The corresponding structures, materials, acts, and equivalents of all means or step plus function elements in the claims below are intended to include any structure, material, or act for performing the function in combination with other claimed elements as specifically claimed. The description of the present disclosed subject matter has been presented for purposes of illustration and description, but is not intended to be exhaustive or limited to the disclosed subject matter in the form disclosed. Many modifications and variations will be apparent to those of ordinary skill in the art without departing from the scope and spirit of the disclosed subject matter. The embodiment was chosen and described in order to best explain the principles of the disclosed subject matter and the practical application, and to enable others of ordinary skill in the art to understand the disclosed subject matter for various embodiments with various modifications as are suited to the particular use contemplated.

The invention claimed is:

1. An engine having two traverses oppositely positioned and linearly actuated, the engine comprising:

a rotor having an inner surface of an outer ring, wherein the rotor is mounted on a shaft of the engine, wherein the rotor is fixed to the shaft that passes through the engine;

two support bearings provided to the rotor, wherein the support bearings are mounted oppositely within the rotor, each support bearing has a revolving insertion positioned between an external ring and an internal ring, wherein the two support bearings are connected to the traverses, and wherein the external ring rolls over the inner surface of the rotor so that a linear movement of the traverses is converted to rotation of the rotor; and an inner ring that is concentric to the outer ring wherein an outer surface of the inner ring is distant from the inner surface of the outer ring in a distance that corresponds the diameter of the external ring of the supporting bearing, wherein the outer ring and the inner ring form an internal restraining path in which the two supporting bearings rotate.

2. The engine as claimed in claim 1, wherein the engine is further provided with pistons that actuate the traverses and the rotors are positioned outwardly of both sides of a housing that accommodate the pistons.

3. The engine as claimed in claim 1, wherein the outer ring is oval.

4. The engine as claimed in claim 1, wherein the support bearings are of a slipper type.

5. The engine as claimed in claim 1, further comprising two pairs of guiding bearings that absorb lateral forces produced during interactions of the support bearings with the rotors.

6. The engine as claimed in claim 5, wherein each of the guiding bearings comprises a movable part consisting of two slides and a fixed part, and wherein the slides are fixed to the traverse while the fixed part is secured to a housing that accommodate pistons that actuate the traverses.

7. The engine as claimed in claim 1, further comprising two engagement units, each engaging the inner surface of the rotor and the corresponding traverse.

8. The engine as claimed in claim 7, wherein the engagement unit is a movable unit that includes an engagement slide capable of sliding along an engagement guide and a rolling bearing that is mounted on the slide.

9. The engine as claimed in claim 1, wherein the inner ring acts as an internal restraining element that prevents the support bearing from detaching of the inner surface of the outer ring.

10. An improvement to a rotor adapted to be rotated by two linearly moving support bearings oppositely positioned and linearly driven by an engine, the improvement comprising:

an outer ring provided on a circumference of the rotor; and an inner ring that is concentric to the outer ring, wherein the support bearings are confined to rotate within a restraining path formed between the outer ring and the inner ring.

11. The improvement as claimed in claim 10, wherein the rotor is oval shaped.

12. The improvement as claimed in claim 10, wherein the inner ring acts as an internal restraining element that is strong enough to endure the environmental conditions and forces inside the engine.

13. The improvement as claimed in claim 11, wherein the inner ring acts as an internal restraining element that is strong enough to endure the environmental conditions and forces inside the engine.

14. The improvement as claimed in claim 10, wherein the support bearings are connected to two oppositely positioned traverses that are linearly actuated by pistons of the engine.

* * * * *